United States Patent [19]

Moss

[11] Patent Number: 4,530,130

[45] Date of Patent: Jul. 23, 1985

[54] MOP SWAB WITH SCREW-ON MOP HEAD

[75] Inventor: Theron C. Moss, Cleveland, Tenn.

[73] Assignee: Seco Industries, Inc., Cleveland, Tenn.

[21] Appl. No.: 498,985

[22] Filed: May 27, 1983

[51] Int. Cl.[3] ..... A47L 13/24

[52] U.S. Cl. ..... 15/229 A; 15/145; 15/147 A

[58] Field of Search ..... 15/145, 228, 147 R, 15/147 A, 229 A, 229 AC

[56] References Cited

U.S. PATENT DOCUMENTS

| | | | |
|---|---|---|---|
| 2,729,841 | 1/1956 | Littleton | 15/229 A |
| 2,880,443 | 4/1959 | LeFebvre | 15/244 R |
| 3,008,166 | 11/1961 | Lay | 15/145 X |
| 3,145,406 | 8/1964 | Lay | 15/229 A X |
| 3,651,533 | 3/1972 | Bouras | 15/229 A |
| 3,703,738 | 11/1972 | Moss et al. | 15/229 A |

*Primary Examiner*—Chris K. Moore

*Attorney, Agent, or Firm*—Maky, Renner, Otto & Boisselle

[57] ABSTRACT

Mop swab includes a threaded center stud supported by a support strip which extends transversely of the mop head and has mop cords covering both the side edges and ends of the support strip. The center stud is located in the approximate center of the length of the support strip, and the ends of the support strip extend in opposite directions beyond the center stud for a substantial portion of the width of the mop head to provide adequate support therefor. The support strip is secured in place intermediate the mop cords by a tape headband which is wrapped around the mop cords and support strip therebetween and stitched to the mop cords by a plurality of rows of stitching extending entirely through the headband and mop cords adjacent the opposite side edges and ends of the support strip.

6 Claims, 4 Drawing Figures

MOP SWAB WITH SCREW-ON MOP HEAD

BACKGROUND OF THE INVENTION

This invention relates generally as indicated to a mop swab with screw-on mop head, and more particularly to a novel method of supporting a threaded center stud from within the mop head.

Heretofore, the primary objection to mop swabs with screw-on style mop heads has been their relatively high cost of manufacture. Also, most such mop swabs include some exposed metal in the region of the mop head which may come into contact with furniture and other surfaces during mopping and mar or otherwise damage such surfaces.

SUMMARY OF THE INVENTION

With the foregoing in mind, it is a principal object of this invention to provide a mop swab with screw-on mop head which is less expensive to manufacture than other similar type mop swabs.

Another object is to provide such a mop swab that does not have any exposed parts to mar or otherwise damage furniture or other surfaces during mopping.

Still another object is to provide such a mop swab in which the support structure for the threaded center stud is completely covered and well cushioned by the mop cords on both sides of the mop head to prevent possible marring or damage to furniture and the like during mopping.

Still another object is to provide such a mop swab in which a conventional fabric headband is used to hold the entire mop head assembly including the support structure for the threaded center stud together.

These and other objects of the present invention may be achieved by providing as the support structure for the threaded center stud a support strip which extends transversely of the mop head at the approximate center thereof and has mop cords completely covering same so that the support strip is adequately cushioned and there are no exposed surfaces to mar or otherwise damage furniture and other surfaces during mopping.

The threaded center stud is located in the approximate center of the length of the support strip, and the ends of the support strip desirably extend beyond the center stud for a substantial portion of the width of the mop head to provide adequate support for the mop head including the mop cords. The support strip is preferably generally channel-shape in cross section with the spacing between the sides of the channel being slightly greater than the distance between opposite sides of a non-circular bolt head on the inner end of the center stud. Accordingly, when the center stud is inserted through a central hole in the base of the channel member from the interior thereof, the sides of the channel member prevent turning of the center stud. The sides of the channel member may also be crimped or swaged in the region of the bolt head after insertion of the center stud through such hole to prevent the center stud from falling out.

The support strip is desirably secured in place intermediate the mop cords by a tape headband which is wrapped around the mop cords and support strip therebetween with the center stud extending outwardly from the support strip between the mop cords and through the tape headband on one side of the mop head. Then the tape headband is stitched to the mop cords by one or more rows of stitching extending entirely through the tape headband and bundle of mop cords across the entire width of the mop head adjacent the opposite side edges of the support strip and along opposite sides of the mop head adjacent the ends of the support strip.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
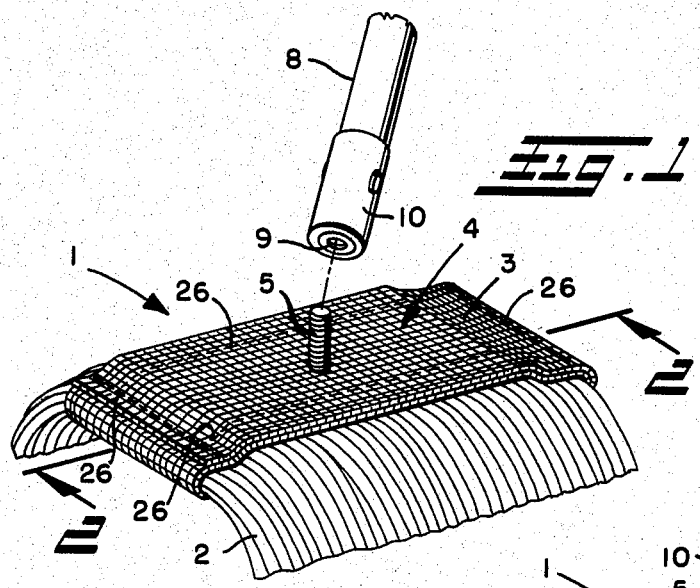
FIG. 1 is a fragmentary perspective view of a preferred form of mop swab with screw-on mop head made in accordance with this invention.
Figure 2:
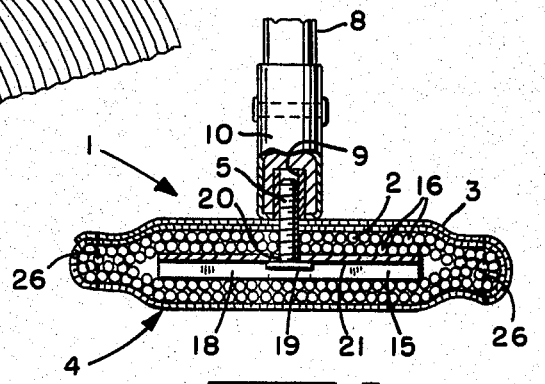
FIG. 2 is a fragmentary transverse section through the mop head of FIG. 1, taken on the plane of the line 2—2 thereof.

Referring now in detail to the drawing and initially to FIG. 1 thereof, there is illustrated a preferred form of mop swab 1 in accordance with this invention including a plurality of mop cords 2 secured together in bunched relation intermediate their ends by a tape headband 3 to provide a mop head 4 as described hereafter. Extending outwardly from one side of the mop head is a threaded center stud or bolt 5 to provide for threaded attachment of the mop head to a mop handle 8 such as shown in FIGS. 1 and 2, which includes a tapped hole 9 in one end 10 that matches the threaded center stud 5. As will be apparent, the threaded handle and center stud are simply screwed together for mopping and unscrewed for changing the mop swab.

As clearly shown in FIG. 2, the center stud 5 is supported within the mop head 4 by a support strip 15 which extends generally transversely of the mop head and is covered by one or more layers 16 of mop cords 2 over both sides of the support strip and at opposite ends thereof to eliminate any exposed surfaces and to cushion the support strip thus to prevent the support strip from marring or otherwise damaging furniture and the like during mopping. While one such layer of mop cords may be sufficient to eliminate any exposed surfaces, it will be apparent that the greater the number of layers the less likely there will be any exposed surfaces and the better the cushioning effect. Accordingly, two or more layers of mop cords desirably cover both sides and both ends of the support strip as shown.

Figure 3:
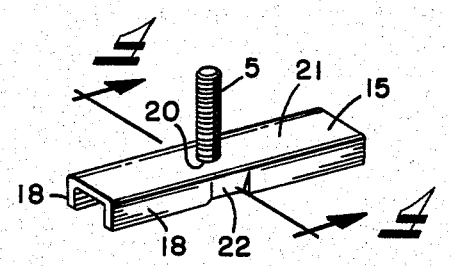
FIG. 3 is a perspective view of the support strip and threaded center stud which constitute part of the mop swab of FIG. 1.
Figure 4:
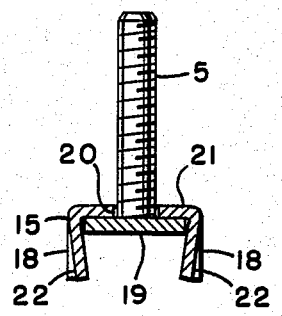
FIG. 4 is an enlarged partial transverse section through the support strip and center stud of FIG. 3, taken on the plane of the line 4—4 thereof.

Preferably, the support strip 15 is generally channel-shape in cross section as illustrated in FIGS. 3 and 4 with the spacing between the sides 18 of the channel being slightly greater than the distance between opposite sides of a non-circular bolt head 19 on the inner end of the center stud. Accordingly, when the center stud is inserted through a central opening 20 in the base 21 of the support strip as shown, the sides of the support strip will prevent turning of the center stud during screwing of the handle thereon and unscrewing such handle. Moreover, the sides of the support strip are desirably crimped or swaged intermediate the ends thereof in line with the bolt head as further shown at 22 in FIGS. 3 and 4 to prevent the center stud from dropping out of the support strip.

With the center stud and support strip properly assembled as shown in FIGS. 2 through 4, the mop cords may be placed over both sides of the support strip and around the ends thereof intermediate the ends of the mop cords as shown in FIG. 2 adequately to cover and cushion the support strip as aforesaid. In such assembly, the ends of the support strip desirably extend in opposite directions beyond the center stud for a substantial portion of the width of the mop head as clearly shown in FIG. 2 so that the support strip will provide adequate support for the mop head including the mop cords. For example, where the mop head 4 has a width of approximately 5½ inches, the support strip 15 may have an overall length of approximately 4 inches, or a length of approximately 2 inches on either side of the center stud. One or both of the support strip and center stud may be made out of metal or plastic, as desired.

The support strip with center stud protruding outwardly therefrom is preferably secured to the mop cords by the tape headband 3 which may be made from a strip of open scrim material or other suitable fabric material. The headband is made by wrapping the tape one or more times around the mop cords and support strip 15 therebetween with the center stud extending outwardly from the support strip between the mop cords and through the fabric tape on one side of the mop head. Then the tape is stitched to the mop cords by one or more rows 26 of stitching extending entirely through the tape and bundle of mop cords across the entire width of the mop head adjacent both side edges of the support strip and also along opposite sides of the mop head adjacent both ends of the support strip thus to hold the entire mop head assembly including the mop cords and tape headband and support strip therewithin together.

If desired, a nut, not shown, could also be threaded onto the stud 5 to hold the headband down and provide a surface for the handle to lock against.

From the foregoing, it will now be apparent that the mop swab of the present invention is of a relatively simple construction and is less expensive and easier to manufacture than similar types of previously known mop swabs including screw-on mop heads.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A mop swab comprising a plurality of mop cords, a fabric headband securing said mop cords together intermediate the ends of said mop cords, an elongated support strip extending transversely of said mop cords beneath said headband, said mop cords overlying the opposite sides and ends of said support strip, and a threaded stud extending through a central opening in said support strip, said threaded stud having a head portion at one end engaging one side of said support strip, the mop cords overlying said one side of said support strip also overlying said head portion, and the other end of said threaded stud extending outwardly between the mop cords overlying the other side of said support strip and through the headband, the ends of said support strip extending in opposite directions beyond said threaded stud for a substantial portion of the width of said headband to provide support for said headband, and securing means for securing said support strip between said mop cords beneath said headband, said support strip being generally channel-shape in cross section including a base member having said central opening therein through which said threaded stud extends outwardly between said mop cords overlying said other side of said support strip and through said headband, and a pair of side members, said head portion of said threaded stud having a non-circular shape which is received between said pair of side members, the spacing between said side members being slightly greater than the spacing between the opposite sides of said non-circular head portion to prevent turning of said threaded stud during screwing of a handle thereon and unscrewing such handle.

2. The mop swab of claim 1 wherein said members of said support strip are crimped toward each other in line with said non-circular head portion of said threaded stud to prevent disassembly of said threaded stud from said support strip.

3. The mop swab of claim 1 wherein there are a plurality of layers of mop cords overlying the opposite sides and ends of said support strip and said head portion.

4. The mop swab of claim 1 wherein said securing means comprises stitching extending entirely through said headband and mop cords adjacent the opposite ends of said support strip.

5. The mop swab of claim 4 wherein said securing means further comprises additional stitching extending entirely through said headband and mop cords adjacent the opposite side edges of said support strip.

6. The mop swab of claim 1 further comprising means for preventing disassembly of said threaded stud from said support strip.

* * * * *